US009850866B2

(12) United States Patent
Yoo et al.

(10) Patent No.: US 9,850,866 B2
(45) Date of Patent: Dec. 26, 2017

(54) HEATER CONTROL APPARATUS FOR DIESEL FUEL FILTER AND DRIVING METHOD THEREOF

(71) Applicants: HYUNDAI MOTOR COMPANY, Seoul (KR); KIA MOTORS CORPORATION, Seoul (KR)

(72) Inventors: Jaebum Yoo, Gunpo-si (KR); Tae Young Kim, Gunpo-si (KR); Sang Il Yoon, Anyang-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 212 days.

(21) Appl. No.: 14/949,850

(22) Filed: Nov. 23, 2015

(65) Prior Publication Data

US 2016/0153401 A1 Jun. 2, 2016

(30) Foreign Application Priority Data

Dec. 2, 2014 (KR) ..... 10-2014-0170352

(51) Int. Cl.

| | |
|---|---|
| ***F02M 15/04*** | (2006.01) |
| ***F02M 37/22*** | (2006.01) |
| ***F02M 19/06*** | (2006.01) |
| ***F02M 15/02*** | (2006.01) |

(52) U.S. Cl.

CPC ..... *F02M 37/223* (2013.01); *F02M 15/025* (2013.01); *F02M 15/045* (2013.01); *F02M 19/063* (2013.01)

(58) Field of Classification Search

CPC .... F02M 15/045; F02M 15/025; F02M 15/04; F02M 15/00; F02M 19/063; F02M 19/066; F02M 37/223

See application file for complete search history.

(56) References Cited

U.S. PATENT DOCUMENTS

2010/0276346 A1* 11/2010 Roesgen ..... B01D 27/06 210/90
2012/0143432 A1* 6/2012 Yoon ..... B01D 35/143 701/29.2

FOREIGN PATENT DOCUMENTS

| | | | |
|---|---|---|---|
| JP | 05-149169 | A | 6/1993 |
| JP | 2002-180887 | A | 6/2002 |
| JP | 2007-329045 | A | 12/2007 |
| JP | 2011-122485 | A | 6/2011 |
| JP | 5381206 | B2 | 1/2014 |
| KR | 10-2012-0060102 | A | 6/2012 |
| KR | 10-1189355 | B1 | 10/2012 |

* cited by examiner

*Primary Examiner* — Jacob Amick

(74) *Attorney, Agent, or Firm* — McDermott Will & Emery LLP

(57) ABSTRACT

A heater control apparatus for a diesel fuel filter according to an exemplary embodiment of the present disclosure includes a fuel temperature sensor for sensing a temperature of diesel fuel, a main relay including a first internal coil and a first switch, a pre-filter heater relay including a second internal coil and a second switch; a first node, a second node, a third node, and an engine control unit (ECU).

13 Claims, 3 Drawing Sheets

HEATER CONTROL APPARATUS FOR DIESEL FUEL FILTER AND DRIVING METHOD THEREOF

CROSS-REFERENCE TO RELATED APPLICATION

This application claims the benefit of priority to Korean Patent Application No. 10-2014-0170352, filed on Dec. 2, 2014 with the Korean Intellectual Property Office, the entire contents of which are incorporated herein by reference.

TECHNICAL FIELD

The present disclosure relates to a heater control apparatus for a diesel fuel filter and a driving method thereof.

BACKGROUND

A diesel fuel filter is used with a diesel fuel supply apparatus in order to filter diesel fuel stored in a fuel tank and supply filtered diesel fuel to a diesel engine.

The diesel fuel filter may filter impurities included in diesel fuel and separate moisture therefrom, and discharge the moisture to the outside. In addition, the diesel fuel filter may heat diesel fuel to prevent coagulation and supply the diesel fuel to the diesel engine. Thus, problems caused by impurities may be prevented in advance.

In order to maintain diesel fuel at an appropriate temperature, the diesel fuel filter includes a filter heater. In addition, a filter heater relay supplying power from a battery to the filter heater or cutting off supply of power is provided between the battery and the filter heater.

If the filter heater relay is stuck open, power cannot be supplied to the filter heater, making it impossible to increase a temperature of diesel fuel to an appropriate temperature during cold weather, which may degrade a cold start of the diesel engine during the winter.

If the filter heater relay is stuck closed, power may continue to be supplied to the filter heater, making a temperature of diesel fuel exceed an appropriate temperature during the summer, damaging the diesel fuel filter.

The above information disclosed in this Background section is only for enhancement of understanding of the background of the disclosure and therefore it may contain information that does not form the prior art that is already known in this country to a person of ordinary skill in the art.

SUMMARY OF THE DISCLOSURE

The present disclosure has been made in an effort to provide a heater control apparatus for a diesel fuel filter and a driving method thereof having advantages of determining a fault of a filter heater relay in real time.

An exemplary embodiment of the present disclosure provides a heater control apparatus for a diesel fuel filter, including: a fuel temperature sensor for sensing a temperature of diesel fuel; a main relay including a first internal coil and a first switch; a pre-filter heater relay including a second internal coil and a second switch; a first node to which a positive terminal of a battery, one end of the first internal coil, one end of the first switch, and one end of the second switch are connected; a second node to which the other end of the first switch and one end of the second internal coil are connected; a third node to which the other end of the second switch, a cathode of a first diode, and a pre-filter heater are connected; and an engine control unit (ECU) including a first switching element connected to the other end of the first internal coil, a second switching element connected to the other end of the second internal coil, and a first monitoring terminal connected to an anode of the first diode, wherein when an ignition switch is turned on, the ECU turns on the first switching element, turns on or turns off the second switching element on the basis of the temperature of the diesel fuel, and determines whether the pre-filter heater relay has an error by checking a current flowing in the first diode through the first monitoring terminal.

When predetermined current flows in the first diode while the second switching element is in an OFF state, the ECU may determine that the pre-filter heater relay is stuck closed.

When predetermined current does not flow in the first diode while the second switching element is in an ON state, the ECU may determine that the pre-filter heater relay is stuck open.

The heater control apparatus may further include: a main filter heater relay including a third internal coil connected to the second node at one end thereof and a third switch connected to the first node at one end thereof; and a fourth node to which the other end of the third switch, a cathode of a second diode, and a main filter heater are connected, wherein the ECU further includes a third switching element connected to the other end of the third internal coil and a second monitoring terminal connected to an anode of the second diode.

The ECU may turn on or turn off the third switching element on the basis of the temperature of the diesel fuel, and determine whether the main filter heater relay has an error by checking a current flowing in the second diode through the second monitoring terminal.

When predetermined current flows in the second diode while the third switching element is in an OFF state, the ECU may determine that the main filter heater relay is stuck closed.

When predetermined current does not flow in the second diode while the third switching element is in an ON state, the ECU may determine that the main filter heater relay is stuck open.

Another exemplary embodiment of the present disclosure provides a method for driving a heater control apparatus for a diesel fuel filter including a fuel temperature sensor for sensing a temperature of diesel fuel; a main relay including a first internal coil and a first switch; a pre-filter heater relay including a second internal coil and a second switch; a first node to which a positive terminal of a battery, one end of the first internal coil, one end of the first switch, and one end of the second switch are connected; a second node to which the other end of the first switch and one end of the second internal coil are connected; a third node to which the other end of the second switch, a cathode of a first diode, and a pre-filter heater are connected; and an engine control unit (ECU) including a first switching element connected to the other end of the first internal coil, a second switching element connected to the other end of the second internal coil, and a first monitoring terminal connected to an anode of the first diode, including: when an ignition switch is turned on, turning on the first switching element; turning on or turning off the second switching element on the basis of the temperature of the diesel fuel; and determining whether the pre-filter heater relay has an error by checking a current flowing in the first diode through the first monitoring terminal The determining of whether the pre-filter heater relay has an error may include: when predetermined current flows in the first diode while the second switching element is in an OFF state, determining that the pre-filter heater is stuck closed.

The determining of whether the pre-filter heater relay has an error may include: when predetermined current does not flow in the first diode while the second switching element is in an ON state, determining that the pre-filter heater is stuck open.

Yet another exemplary embodiment of the present disclosure provides a method for driving a heater control apparatus for a diesel fuel filter including a fuel temperature sensor for sensing a temperature of diesel fuel; a main relay including a first internal coil and a first switch; a pre-filter heater relay including a second internal coil and a second switch; a main filter heater relay including a third internal coil and a third switch; a first node to which a positive terminal of a battery, one end of the first internal coil, one end of the first switch, one end of the second switch, and one end of the third switch are connected; a second node to which the other end of the first switch, one end of the second internal coil, and one end of the third internal coil are connected; a third node to which the other end of the second switch, a cathode of a first diode, and a pre-filter heater are connected; a fourth node to which the other end of the third switch, a cathode of a second diode, and a main filter heater are connected; and an engine control unit (ECU) including a first switching element connected to the other end of the first internal coil, a second switching element connected to the other end of the second internal coil, a third switching element connected to the other end of the third internal coil, a first monitoring terminal connected to an anode of the first diode, and a second monitoring terminal connected to an anode of the second diode, the method including: when an ignition switch is turned on, turning on the first switching element; turning on or turning off the second switching element on the basis of the temperature of the diesel fuel; and determining whether the main filter heater relay has an error by checking a current flowing in the second diode through the second monitoring terminal.

The determining of whether the main filter heater relay has an error may include: when predetermined current flows in the second diode while the third switching element is in an OFF state, determining that the main filter heater relay is stuck closed.

The determining of whether the main filter heater relay has an error may include: when the predetermined current does not flow in the second diode while the third switching element is in an ON state, determining that the main filter heater relay is stuck open.

According to an exemplary embodiment of the present disclosure, a fault of the filter heater relay may be determined in real time. Thus, damage to the diesel fuel filter due to a fault of the filter heater relay may be prevented. In addition, a degradation of a cold start of the diesel engine during the winter may be prevented in advance.

DETAILED DESCRIPTION

Figure 1:
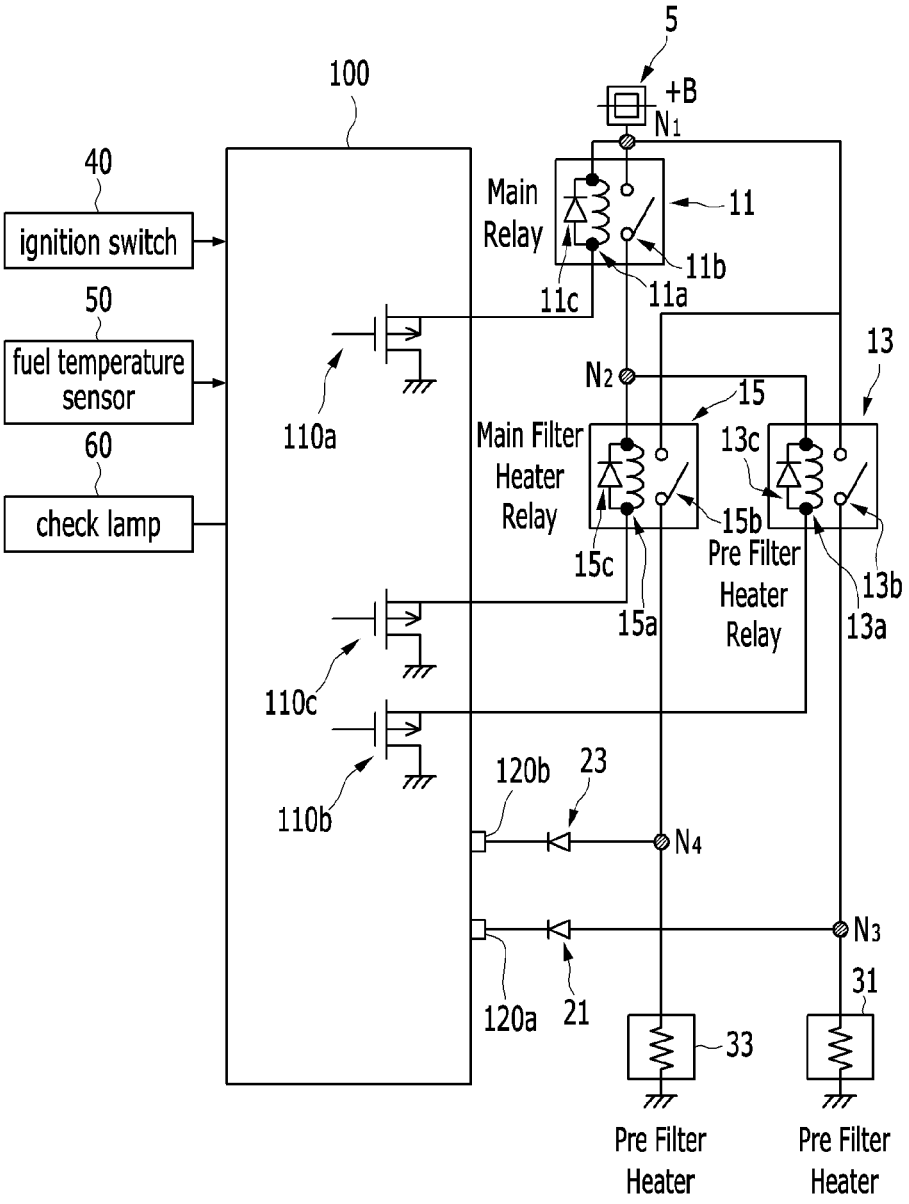
FIG. 1 is a schematic view illustrating a configuration of a heater control apparatus for a diesel fuel filter according to an exemplary embodiment of the present disclosure.

Hereinafter, the present disclosure will be described more fully with reference to the accompanying drawings, in which exemplary embodiments of the disclosure are shown.

In the drawings, the components are arbitrarily shown for the description purposes, so the present disclosure is not limited to the illustrations of the drawings.

FIG. 1 is a view illustrating a configuration of a heater control apparatus for a diesel fuel filter according to an exemplary embodiment of the present disclosure.

As illustrated in FIG. 1, a heater control apparatus for a diesel fuel filter according to an exemplary embodiment of the present disclosure may include a fuel temperature sensor 50, a main relay 11, a pre-filter heater relay 13, a main filter heater relay 15, and an engine control unit (ECU) 100.

The fuel temperature sensor 50 senses a temperature of diesel fuel and transfers a corresponding signal to the ECU 100.

When an ignition switch 40 is turned on, the ECU 100 drives the heater control apparatus for a diesel fuel filter according to an exemplary embodiment of the present disclosure.

The ECU 100 may be implemented with one or more microprocessors executed by a preset program, and the preset program may include a series of commands for performing each step included in a method for driving a heater control apparatus for a diesel fuel filter according to an exemplary embodiment of the present disclosure described hereinafter.

The ECU 100 may include a first switching element 110*a*, a second switching element 110*b*, and a third switching element 110*c*. The first switching element 110*a*, the second switching element 110*b*, and the third switching element 110*c* may be a MOSFET, but the present disclosure is not limited thereto.

The main relay 11 may supply power of a battery to various power loads using power from the battery, or may cut off power supply thereto.

The main relay 11 may include a first internal coil 11*a*, a first switch 11*b*, and a first freewheeling diode 11*c*.

When the ignition switch 40 is turned on, the ECU 100 turns on the main relay 11. When the ignition switch 40 is turned on, the ECU 100 turns on the first switching element 110*a*. Accordingly, current flows in the first internal coil 11*a* and the first switch 11*b* is turned on to supply battery power to various power loads using the power of the battery. To this end, a positive terminal 5 of the battery, one end of the first internal coil 11*a*, and one end of the first switch 11*b* are connected to a first node N1. In order to remove a counter electromotive voltage generated in the first internal coil 11*a*, the first freewheeling diode 11*c* may be connected to the first internal coil 11*a* in parallel.

The diesel fuel filter may include a pre-filter and a main filter in order to filter out impurities included in diesel fuel and separate moisture therefrom and discharge the separated moisture to the outside. The pre-filter primarily filters out relatively large impurities and the main filter secondarily filters out relatively small impurities remaining after primary screening of the pre-filter.

The pre-filter heater 31 may be configured as a positive temperature coefficient (PTC) device capable of heating diesel fuel introduced to the pre-filter.

In order to supply power to the pre-filter heater 31 or cut off power supply to the pre-filter heater 31, the pre-filter heater relay 13 is disposed at one end of the pre-filter heater 31.

The pre-filter heater relay 13 may include a second internal coil 13*a*, a second switch 13*b*, and a second freewheeling diode 13*c*. The ECU 100 turns on or turns off the pre-filter heater relay 13 on the basis of a temperature of diesel fuel sensed by the fuel temperature sensor 50. When a temperature of the diesel fuel is lower than a preset temperature, the ECU 100 turns on the second switching element 110*b*. Accordingly, current flows in the second internal coil 13*a*, the second switch 13*b* is turned on, and power of the battery is supplied to the pre-filter heater 31. To this end, one end of the second switch 13*b* is connected to the first node N1 and the other end of the second switch 13*b* is connected to the pre-filter heater 31. Also, the other end of the first switch 11*b* and one end of the second internal coil 13*a* are connected to the second node N2. In order to remove a counter electromotive voltage generated in the second internal coil 13*a*, the second freewheeling diode 13*c* may be connected to the second internal coil 13*b* in parallel.

In order to determine whether the pre-filter heater relay 13 has an error, the ECU 100 may further include a first monitoring terminal 120*a* connected to an anode of a first diode 21. The other end of the second switch 13*b*, a cathode of the first diode 21, and the pre-filter heater 31 are connected to a third node N3. The ECU 100 may determine whether the pre-filter heater relay 13 has an error by checking a current flowing in the first diode 21 through the first monitoring terminal 120*a*.

The ECU 100 may determine whether the pre-filter heater relay 13 is stuck closed while the pre-filter heater 31 is not being driven. For example, when a temperature of diesel fuel is higher than the preset temperature, the second switching element 110*b* is maintained in an OFF state. Here, when the pre-filter heater relay 13 is normal, the second switch 13*b* is to be maintained in an OFF state and a current will not flow in the first diode 21. However, when predetermined current flows in the first diode 21 while the second switching element 110*b* is in the OFF state, the ECU 100 may determine that the pre-filter heater relay 13 is stuck closed.

Also, the ECU 100 may determine whether the pre-filter heater relay 13 is stuck open while the pre-filter heater 31 is being driven. For example, when a temperature of diesel fuel is lower than the preset temperature, the second switching element 110*b* is maintained in an ON state. Here, when the pre-filter heater relay 13 is normal, the second switch 13*b* is to be maintained in an ON state and current will flow in the first diode 21. However, when predetermined current does not flow in the first diode 21 while the second switching element 110*b* is in the ON state, the ECU 100 may determine that the pre-filter heater relay 13 is stuck open.

When it is determined that the pre-filter heater relay 13 is stuck closed or open, the ECU 100 may turn on a check lamp 60 to allow a corresponding driver to move a corresponding vehicle to a repair shop.

The main filter heater 33 may also be configured as a positive temperature coefficient (PTC) device capable of heating diesel fuel introduced to the main filter.

In order to supply power to the main filter heater 33 or cut off the power supply thereto, the main filter heater relay 15 is disposed at one end of the main filter heater 33.

The main filter heater relay 15 may include a third internal coil 15*a*, a third switch 15*b*, and a third freewheeling diode 15*c*. The ECU 100 turns on or turns off the main filter heater relay 15 on the basis of a temperature of diesel fuel sensed by the fuel temperature sensor 50. When a temperature of the diesel fuel is lower than a preset temperature, the ECU 100 turns on the third switching element 110*c*. Accordingly, current flows in the third internal coil 15*a*, the third switch 15*b* is turned on, and power of the battery is supplied to the main filter heater 33. To this end, one end of the third switch 15*b* is connected to the first node N1 and the other end of the third switch 15*b* is connected to the main filter heater 33. Also, one end of the third internal coil 15*a* is connected to the second node N2. In order to remove a counter electromotive voltage generated in the third internal coil 15*a*, the third freewheeling diode 15*c* may be connected to the third internal coil 15*a* in parallel.

In order to determine whether the main filter heater relay 15 has an error, the ECU 100 may further include a second monitoring terminal 120*b* connected to an anode of a second diode 23. The other end of the third switch 15*b*, a cathode of the second diode 23, and the main filter heater 33 are connected to a fourth node N4. The ECU 100 may determine whether the main filter heater relay 15 has an error by checking a current flowing in the second diode 23 through the second monitoring terminal 120*b*.

The ECU 100 may determine whether the main filter heater relay 15 is stuck closed while the main filter heater 33 is not being driven. For example, when a temperature of diesel fuel is higher than the preset temperature, the third switching element 110*c* is maintained in an OFF state. Here, when the main filter heater relay 15 is normal, the third switch 15*b* is to be maintained in an OFF state and a current is not to flow in the second diode 23. However, when predetermined current flows in the second diode 23 while the third switching element 110*c* is in the OFF state, the ECU 100 may determine that the main filter heater relay 15 is stuck closed.

Also, the ECU 100 may determine whether the main filter heater relay 15 is stuck open while the main filter heater 33 is being driven. For example, when a temperature of the diesel fuel is lower than the preset temperature, the third switching element 110*c* is maintained in an ON state. Here, when the main filter heater relay 15 is normal, the third switch 15*b* is to be maintained in an ON state and current is to flow in the second diode 23. However, when predetermined current does not flow in the second diode 23 while the third switching element 110*c* is in the ON state, the ECU 100 may determine that the main filter heater relay 15 is stuck open.

When it is determined that the main filter heater relay 15 is stuck closed or open, the ECU 100 may turn on the check lamp 60 to allow the driver to move the vehicle to a repair shop.

Figure 2:
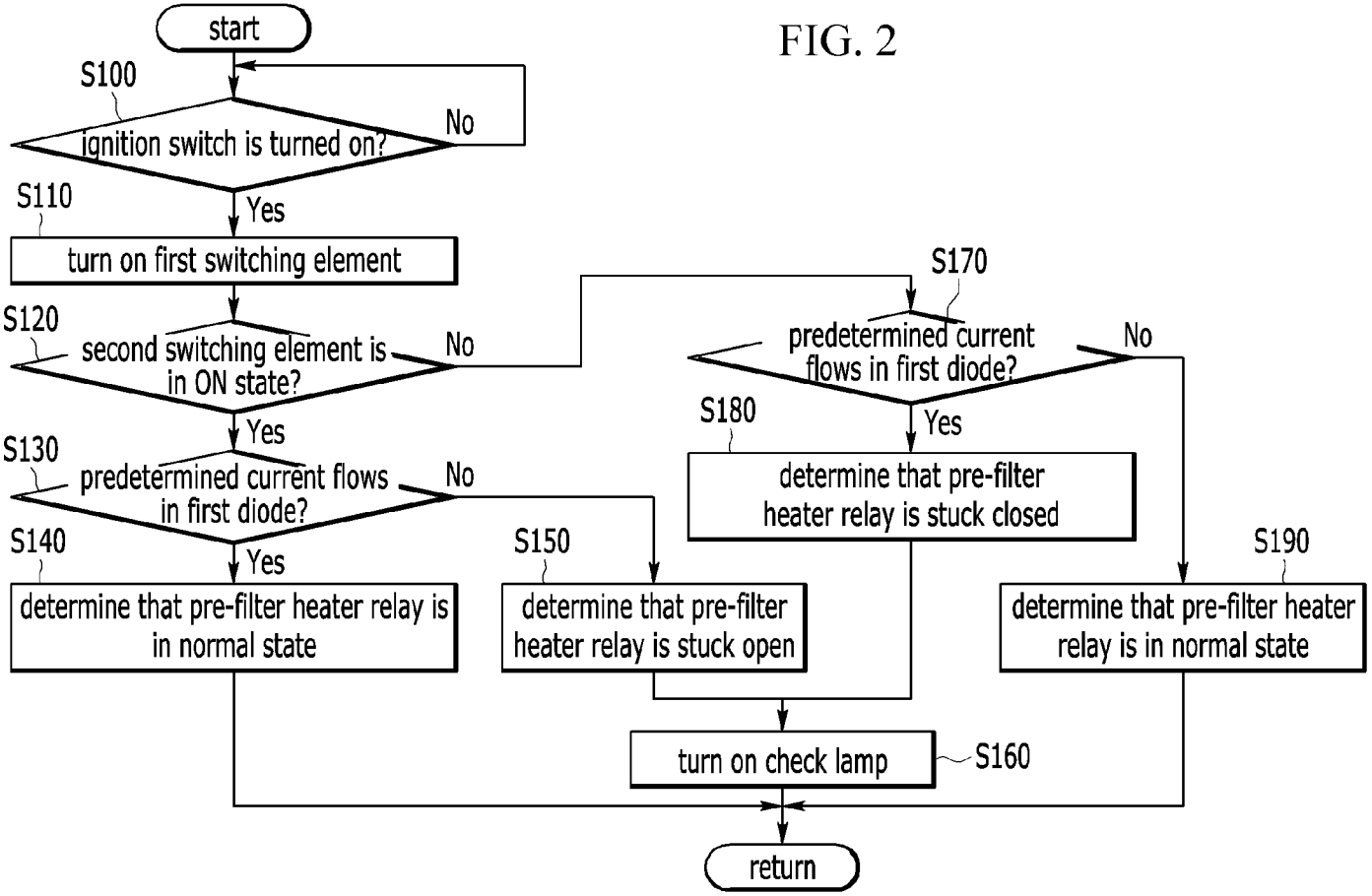
FIGS. 2 and 3 are flow charts illustrating a method for driving a heater control apparatus for a diesel fuel filter according to an exemplary embodiment of the present disclosure.
Figure 3:
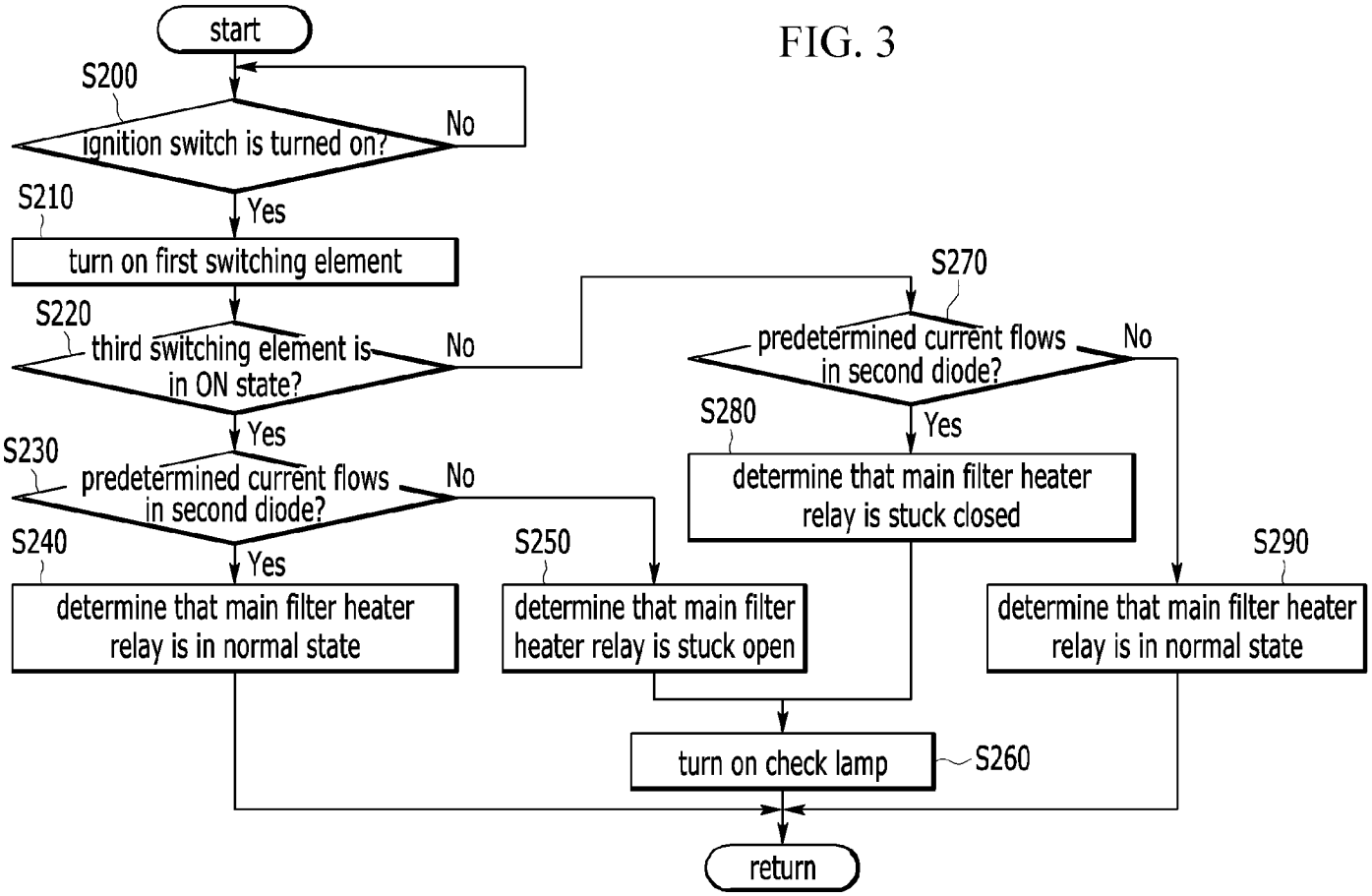

FIGS. 2 and 3 are flow charts illustrating a method for driving a heater control apparatus for a diesel fuel filter according to an exemplary embodiment of the present disclosure.

Referring to FIG. 2, the ECU 100 may determine whether the pre-filter heater relay 13 has an error by checking a current flowing in the first diode 21 through the first monitoring terminal 120*a*.

The ECU 100 determines whether the ignition switch 40 is in a turned-on state (S100).

When the ignition switch is in the turned-on state, the ECU 100 turns on the first switching element 110*a* (S110). Thereafter, the ECU 100 drives the pre-filter heater 31 or stops driving of the pre-filter heater 31 by turning on or off the second switching element 110*b* on the basis of a temperature of diesel fuel.

The ECU 100 determines whether the second switching element 110*b* is in an ON state (S120).

When the second switching element 110*b* is in the ON state, the ECU 100 determines whether predetermined current flows in the first diode 21 (S130).

When the predetermined current flows in the first diode 21 while the second switching element 110*b* is in the ON state, the ECU 100 may determine that the pre-filter heater relay 13 is in a normal state (S140).

In contrast, when the predetermined current does not flow in the first diode 21 while the second switching element 110*b* is in the ON state, the ECU 100 may determine that the pre-filter heater relay 13 is stuck open (S150). In this case, the ECU 100 may turn on the check lamp 60 to allow the driver to move the vehicle to a repair shop (S160).

Meanwhile, when the second switching element 110*b* is in an OFF state in step S120, the ECU 100 may determine whether the predetermined current flows in the first diode 21 (S170).

When the predetermined current flows in the first diode 21 while the second switching element 110*b* is in the OFF state, the ECU 100 may determine that the pre-filter heater relay 13 is stuck closed (S180). In this case, the ECU 100 may turn on the check lamp 60 to allow the driver to move the vehicle to a repair shop (S160).

When the predetermined current does not flow in the first diode 21 while the second switching element 110*b* is in the OFF state, the ECU 100 may determine that the pre-filter heater relay 13 is in a normal state (S190).

Referring to FIG. 3, the ECU 100 may determine whether the main filter heater relay 15 has an error by checking a current flowing in the second diode 23 through the second monitoring terminal 120*b*.

The ECU 100 may determine whether the ignition switch 40 is in a turned-on state (S200).

When the ignition switch 40 is in the turned-on state, the ECU 100 turns on the first switching element 110*a* (S210). Thereafter, the ECU 100 drives the main filter heater 33 or stops driving thereof by turning on or off the third switching element 110*c* on the basis of a temperature of diesel fuel.

The ECU 100 determines whether the third switching element 110*c* is in an ON state (S220).

When the third switching element 110*c* is in the ON state, the ECU 100 may determine whether predetermined current flows in the second diode 23 (S230).

When the predetermined current flows in the second diode 23 while the third switching element 110*c* is in the ON state, the ECU 100 may determine that the main filter heater relay 15 is in a normal state (S240).

In contrast, when the predetermined current does not flow in the second diode 23 while the third switching element 110*c* is in the ON state, the ECU 100 may determine that the main filter heater relay 15 is stuck open (S250). In this case, the ECU 100 may turn on the check lamp 60 to allow the driver to move the vehicle to a repair shop (S260).

Meanwhile, when the third switching element 110*c* is in an OFF state in step S220, the ECU 100 determines whether predetermined current flows in the second diode 23 (S270).

When the predetermined current flows in the second diode 23 while the third switching element 110*c* is in the OFF state, the ECU 100 may determine that the main filter heater relay 15 is stuck closed (S280). In this case, the ECU 100 may turn on the check lamp 60 to allow the driver to move the vehicle to a repair shop (S260).

When the predetermined current does not flow in the second diode 23 while the third switching element 110*c* is in the OFF state, the ECU 100 may determine that the main filter heater relay 15 is in a normal state (S290).

As described above, according to an exemplary embodiment of the present disclosure, a fault of the filter heater relay may be determined in real time. Thus, damage to the diesel fuel filter according to the fault of the filter heater relay may be prevented. In addition, a degradation of a cold start of the diesel engine during cold weather may be prevented in advance.

While this disclosure has been described in connection with what is presently considered to be practical exemplary embodiments, it is to be understood that the disclosure is not limited to the disclosed exemplary embodiments, but, on the contrary, is intended to cover various modifications and equivalent arrangements included within the spirit and scope of the appended claims.

What is claimed is:

1. A heater control apparatus for a diesel fuel filter, comprising:

a fuel temperature sensor for sensing a temperature of diesel fuel;

a main relay including a first internal coil and a first switch;

a pre-filter heater relay including a second internal coil and a second switch;

a first node to which a positive terminal of a battery, one end of the first internal coil, one end of the first switch, and one end of the second switch are connected;

a second node to which the other end of the first switch and one end of the second internal coil are connected;

a third node to which the other end of the second switch, an anode of a first diode, and a pre-filter heater are connected; and an engine control unit (ECU) including a first switching element connected to the other end of the first internal coil, a second switching element connected to the other end of the second internal coil, and a first monitoring terminal connected to a cathode of the first diode, wherein when an ignition switch is turned on, the ECU turns on the first switching element, turns on or off the second switching element on the basis of the temperature of the diesel fuel, and determines whether the pre-filter heater relay has an error by checking a current flowing in the first diode through the first monitoring terminal.

2. The heater control apparatus of claim 1, wherein: when predetermined current flows in the first diode while the second switching element is in an OFF state, the ECU determines that the pre-filter heater relay is stuck closed.

3. The heater control apparatus of claim 1, wherein: when predetermined current does not flow in the first diode while the second switching element is in an ON state, the ECU determines that the pre-filter heater relay is stuck open.

4. The heater control apparatus of claim 1, further comprising:

a main filter heater relay including a third internal coil connected to the second node at one end thereof and a third switch connected to the first node at one end thereof; and a fourth node to which the other end of the third switch, an anode of a second diode, and a main filter heater are connected, wherein the ECU further includes a third switching element connected to the other end of the third internal coil and a second monitoring terminal connected to a cathode of the second diode.

5. The heater control apparatus of claim 4, wherein the ECU turns on or turns off the third switching element on the basis of the temperature of the diesel fuel, and determines whether the main filter heater relay has an error by checking a current flowing in the second diode through the second monitoring terminal.

6. The heater control apparatus of claim 5, wherein when predetermined current flows in the second diode while the third switching element is in an OFF state, the ECU determines that the main filter heater relay is stuck closed.

7. The heater control apparatus of claim 5, wherein, when predetermined current does not flow in the second diode while the third switching element is in an ON state, the ECU determines that the main filter heater relay is stuck open.

8. A method for driving a heater control apparatus for a diesel fuel filter including a fuel temperature sensor for sensing a temperature of diesel fuel; a main relay including a first internal coil and a first switch; a pre-filter heater relay including a second internal coil and a second switch; a first node to which a positive terminal of a battery, one end of the first internal coil, one end of the first switch, and one end of the second switch are connected; a second node to which the other end of the first switch and one end of the second internal coil are connected; a third node to which the other end of the second switch, an anode of a first diode, and a pre-filter heater are connected; and an engine control unit (ECU) including a first switching element connected to the other end of the first internal coil, a second switching element connected to the other end of the second internal coil, and a first monitoring terminal connected to a cathode of the first diode, the method comprising:

when an ignition switch is turned on, turning on the first switching element;

turning on or turning off the second switching element on the basis of the temperature of the diesel fuel; and determining whether the pre-filter heater relay has an error by checking a current flowing in the first diode through the first monitoring terminal.

9. The method of claim 8, wherein the determining of whether the pre-filter heater relay has an error includes:

when predetermined current flows in the first diode while the second switching element is in an OFF state, determining that the pre-filter heater is stuck closed.

10. The method of claim 8, wherein the determining of whether the pre-filter heater relay has an error includes:

when predetermined current does not flow in the first diode while the second switching element is in an ON state, determining that the pre-filter heater is stuck open.

11. A method for driving a heater control apparatus for a diesel fuel filter including a fuel temperature sensor for sensing a temperature of diesel fuel; a main relay including a first internal coil and a first switch; a pre-filter heater relay including a second internal coil and a second switch; a main filter heater relay including a third internal coil and a third switch; a first node to which a positive terminal of a battery, one end of the first internal coil, one end of the first switch, one end of the second switch, and one end of the third switch are connected; a second node to which the other end of the first switch, one end of the second internal coil, and one end of the third internal coil are connected; a third node to which the other end of the second switch, an anode of a first diode, and a pre-filter heater are connected; a fourth node to which the other end of the third switch, an anode of a second diode, and a main filter heater are connected; and an engine control unit (ECU) including a first switching element connected to the other end of the first internal coil, a second switching element connected to the other end of the second internal coil, a third switching element connected to the other end of the third internal coil, a first monitoring terminal connected to a cathode of the first diode, and a second monitoring terminal connected to a cathode of the second diode, the method comprising:

when an ignition switch is turned on, turning on the first switching element;

turning on or turning off the second switching element on the basis of the temperature of the diesel fuel; and determining whether the main filter heater relay has an error by checking a current flowing in the second diode through the second monitoring terminal.

12. The method of claim 11, wherein the determining of whether the main filter heater relay has an error includes:

when predetermined current flows in the second diode while the third switching element is in an OFF state, determining that the main filter heater relay is stuck closed.

13. The method of claim 11, wherein the determining of whether the main filter heater relay has an error includes:

when predetermined current does not flow in the second diode while the third switching element is in an ON state, determining that the main filter heater relay is stuck open.

* * * * *